US008752470B2

(12) United States Patent
Kocher et al.

(10) Patent No.: US 8,752,470 B2
(45) Date of Patent: Jun. 17, 2014

(54) REDUCED SIZE, SYMMETRICAL AND ASYMMETRICAL CREW COMPARTMENT VEHICLE CONSTRUCTION

(75) Inventors: Robert W Kocher, McLean, VA (US); David Simon, Alexandria, VA (US)

(73) Assignee: Ideal Innovations Incorporated, Arlington, VA (US)

( * ) Notice: Subject to any disclaimer, the term of this patent is extended or adjusted under 35 U.S.C. 154(b) by 323 days.

(21) Appl. No.: 13/017,662

(22) Filed: Jan. 31, 2011

(65) Prior Publication Data

US 2012/0192708 A1 Aug. 2, 2012

(51) Int. Cl.
*F41H 7/02* (2006.01)

(52) U.S. Cl.
USPC ..... 89/36.08

(58) Field of Classification Search
USPC ..... 89/36.01, 36.07, 36.08, 36.09; 296/187.07, 187.08, 64, 190.03, 296/190.01, 193.04
See application file for complete search history.

(56) References Cited

U.S. PATENT DOCUMENTS 3,139,797 A * 7/1964 Fair et al. ..... 89/36.08
7,228,927 B2 * 6/2007 Hass et al. ..... 180/65.25
7,357,062 B2 * 4/2008 Joynt ..... 89/36.08
7,401,540 B1 7/2008 Kocher
7,878,104 B2 * 2/2011 Floch ..... 89/36.09
7,987,762 B2 8/2011 Joynt et al.
7,997,182 B1 8/2011 Cox
8,146,477 B2 * 4/2012 Joynt ..... 89/36.08
8,146,478 B2 * 4/2012 Joynt et al. ..... 89/36.08
2005/0235819 A1 * 10/2005 Long ..... 89/36.07
2006/0201319 A1 * 9/2006 De Wet ..... 89/36.09
2007/0186762 A1 * 8/2007 Dehart et al. ..... 89/36.09
2008/0236378 A1 * 10/2008 Sane et al. ..... 89/36.02
2009/0293712 A1 * 12/2009 Ran et al. ..... 89/36.08
2010/0163330 A1 * 7/2010 Halliday ..... 180/295
2011/0148147 A1 6/2011 Kendall et al.
2011/0260495 A1 * 10/2011 Hafften et al. ..... 296/146.1
2012/0137867 A1 6/2012 Guha et al.

* cited by examiner

*Primary Examiner* — Gabriel Klein
(74) *Attorney, Agent, or Firm* — Andrew Wichmann

(57) ABSTRACT

A vehicle construction in which a survivability capsule and underbody V-deflector plate are located off-center relative to the vehicle providing desirable survivability and size characteristics, and minimizing overall vehicle width providing desirable maneuverability characteristics. The survivability capsule is constructed around occupants oriented to minimize capsule width and may incorporate traditional or spaced frame construction. The location of the capsule provides the ability to incorporate a large amount of storage area into the construction of the vehicle, or to use a spaced armor array on one side of the capsule providing protection from road-side threats including EFPs, RPGs, and RKG-3s.

19 Claims, 5 Drawing Sheets

REDUCED SIZE, SYMMETRICAL AND ASYMMETRICAL CREW COMPARTMENT VEHICLE CONSTRUCTION

CROSS-REFERENCE TO RELATED APPLICATIONS

This application claims the benefit to U.S. provisional patent application No. 61/285,736 filed on Feb. 1, 2010.

BACKGROUND

This invention generally relates to vehicle construction. Specifically, the invention relates to the construction of a vehicle providing desirable maneuverability, survivability, and fightability characteristics for military and government-type missions. These desirable features are achieved through (1) the design of a small, reduced-crew-size, survivability capsule with a unique seating plan and (2) the unique positioning of this capsule relative to other major vehicle components. This results in the ability to successfully carry required equipment and cargo without the vehicle weight increase that typically accompanies carrying these items under-armor.

With the ongoing conflicts in Iraq and Afghanistan, the role of military vehicles is more critical than ever. In practice, many of the vehicles presently deployed by the US military are not well-suited dimensionally to the rough terrain present in these environments. Common disadvantages of present military vehicles include their wide width relative to the width of secondary roads and other byways, large turning radii relative to the roads and paths which negotiate the rough mountainous terrain, slow speed compared to other over-the-road military vehicles and potentially high casualty rates when a single vehicle is targeted with an Improvised Explosive Device (IED) or other enemy weapon.

Past efforts have related to construction of vehicles with unique engine locations, monocoque V-hulls for blast survivability, and spaced armor on both sides of the vehicle for Explosively Formed Projectile (EFP) survivability. The resulting vehicles have included the MRAP All Terrain Vehicle (MATV), the Mine Resistant Ambush Protected (MRAP) class of vehicles, the Armored Security Vehicle (ASV), the Highly Survivable Urban Utility Vehicle (HS-UUV), and other vehicles. No previous efforts have sought to provide the desired maneuverability, survivability, and fightability by providing a narrow, offset cab, offset underbody V-plates, and a reduced crew capacity, together with the overall envelope of a conventional vehicle incorporating equipment and other storage, as well as options for overhead systems including weapons and optics.

Accordingly, several objects and advantages of the invention are:

(A) to provide a light vehicle construction (weighing 25,000 lbs or less) that reduces the underbody mine and improvised explosive device (IED) areas of the crew compartments thus providing greater crew survivability;

(B) to provide a light vehicle construction that allows for protection against heavy armor threat categories such as Explosively Formed Projectiles (EFPs), Rocket Propelled Grenades (RPGs), hand grenades, armor piercing bullets and other threats typically related to larger vehicle classes;

(C) to provide a light vehicle construction optimized to provide desirable optics and weapon mount capability producing desirable overall observation and fightability characteristics;

(D) to provide a vehicle in which the occupants are arranged to minimize the capsules width (96 inches or less) by using sideways seating, or in-line seating;

(E) to provide a vehicle constructed around a slender survivability capsule housing two or three occupants, and resulting in a narrow vehicle width, enabling maneuverability on secondary roads not wide enough to permit traverse in wide vehicles such as HMMWVs, MATVs, and MRAP;

(F) to provide a vehicle utilizing a narrow survivability capsule that provides desirable survivability characteristics against underbody threats including IEDs.

(G) to provide a vehicle constructed around a narrow survivability capsule that is located off-center relative to the vehicle permitting the use of narrow underbody V-plate capable of deflecting blast, and positioned adjacent to major vehicle underbody components including driveline and transmission components;

(H) to provide a vehicle constructed around a narrow survivability capsule that incorporates the ability to hold and transport a large volume of equipment on the side of the vehicle adjacent to the survivability capsule, thereby balancing the vehicle's weight, and providing a location for a widely spaced armor package protecting one side of the survivability capsule from threats such as EFPs, RPGs, and RKG-3s;

(I) to provide a vehicle with a center of gravity more favorably loading wheels on the side with the survivability capsule, thereby reducing the occurrence of road bed failure under the outside wheels which can lead to vehicle rollover and potential loss of life; and (J) to provide a vehicle constructed around a narrow survivability capsule and incorporating top mounted weapons and surveillance systems that can be operated by occupants of the survivability capsule.

In accordance with the present invention the Reduced Size, Symmetrical and Asymmetrical Crew Compartment Vehicle Construction is a new, unique concept in vehicle design and construction and enables a number of desirable characteristics to be realizable on a single chassis.

SUMMARY

The reader will see a vehicle construction in which a unique occupant configuration enables the construction of a survivability capsule having desirable underbody blast survivability characteristics. This survivability capsule is positioned offset to the overall vehicle enabling the vehicle's underbody V-deflector plate to be positioned alongside, rather than around or above traditional driveline and other underbody vehicle components. The placement of the survivability capsule also enables the use of a spaced armor array from one side of the vehicle providing desirable survivability characteristics from threats including EFPs, RPGs, and RKG-3s.

DETAILED DESCRIPTION

Figure 1:
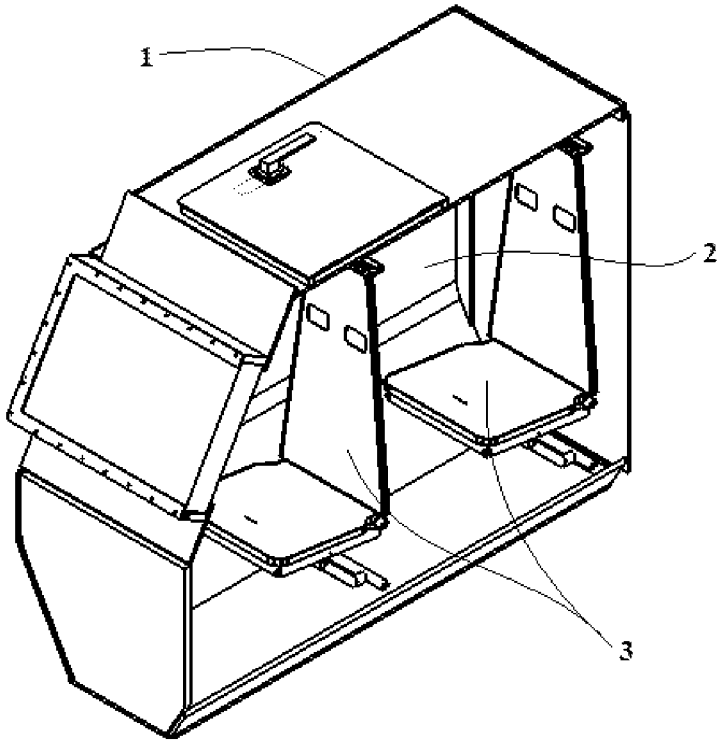
FIG. 1 shows a perspective view of a two-occupant survivability capsule.

FIG. 1 shows the preferred embodiment of the survivability capsule 1 configured for two occupants. The preferred embodiment of the invention as a whole is an armored wheeled vehicle, comprising a lightly armored, offset survivability capsule, having a front, back, sides, bottom, and a top; a V-deflector plate connected along the length of the bottom of said survivability capsule; a chassis operatively connected to said survivability capsule; at least two axles operatively connected to said chassis; and at least four wheels, each operatively connected to said at least two axles. The vehicle walls 2 may be constructed with steel or other ballistic material, or may incorporate a spaced-frame construction in which an internal frame structure is used to support lightweight armor panels providing protect on from small arms and fragmentation resulting from blast events. The seats 3 are oriented to minimize capsule width. They may be designed to provide ballistic protection from threats including rifle threats and blast threats. These seats may be mounted to the vehicle floor, wall, or ceiling, and may or may not contain deformable elements designed to mitigate blast effects. These seats are arranged with one forward, and one directly behind and in-line with the forward seat. The forward occupant is the vehicle driver, and the rear occupant may be responsible for operating the vehicle's communications, surveillance, and/or weapon systems. The in-line positioning of the seats permits a very narrow cab construction. The seats may be configured to fold, or otherwise move out of the user's way when needed.

Figure 2:
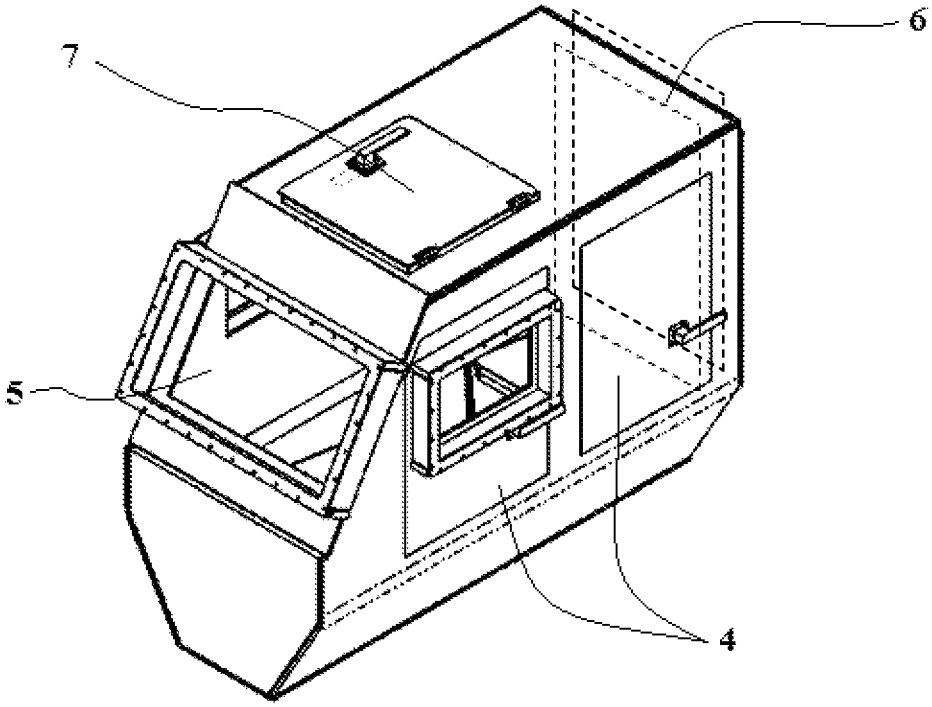
FIG. 2 shows a perspective view of the multiple exits available to the occupants of the survivability capsule.

FIG. 2 shows the multiple exits available to occupants of the survivability capsule, including one or more side doors 4 which may be hinged at the front or rear and are located on the side closest to the edge of the vehicle, a push-out windshield 5 permitting escape from the vehicle during roll-over or underwater events, a rear door 6 that may be hinged on the sides or bottom, and overhead hatches 7 which may be hinged at either or both sides (split in the center).

Figure 3:
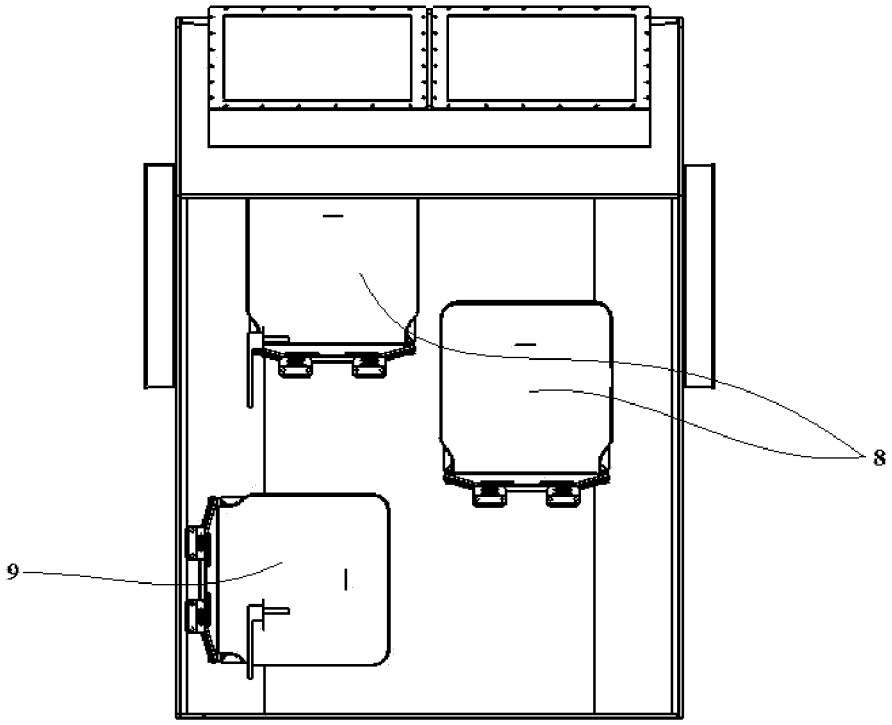
FIG. 3 shows a top view of a three-man occupant survivability capsule.

The survivability capsule may contain two or three occupant seats oriented to minimize capsule width. FIG. 3 shows how three seats may be oriented to minimize capsule width. In this configuration, two occupants 8 face forward, and a third 9 is facing the vehicle's interior wall, permitting the construction of a slender, relatively short survivability capsule. The seats may be configured to fold, or otherwise move out of the user's way when needed.

Figure 4:
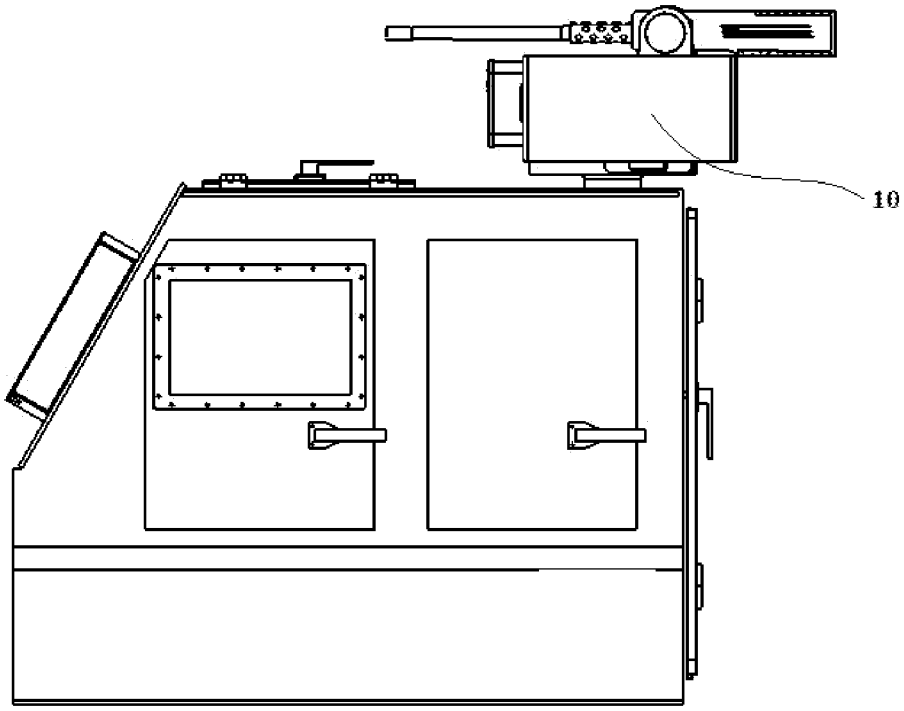
FIG. 4 shows a side view of the location of weapon or surveillance systems relative to the vehicle.

FIG. 4 shows the location of the weapon system 10 relative to the survivability capsule 1. A surveillance system may also be located where the weapon system is depicted. The weapon or surveillance system may be mounted on the top of the survivability capsule as shown, or alternatively along either side to reduce overall vehicle height and center-of-gravity height.

Figure 5:
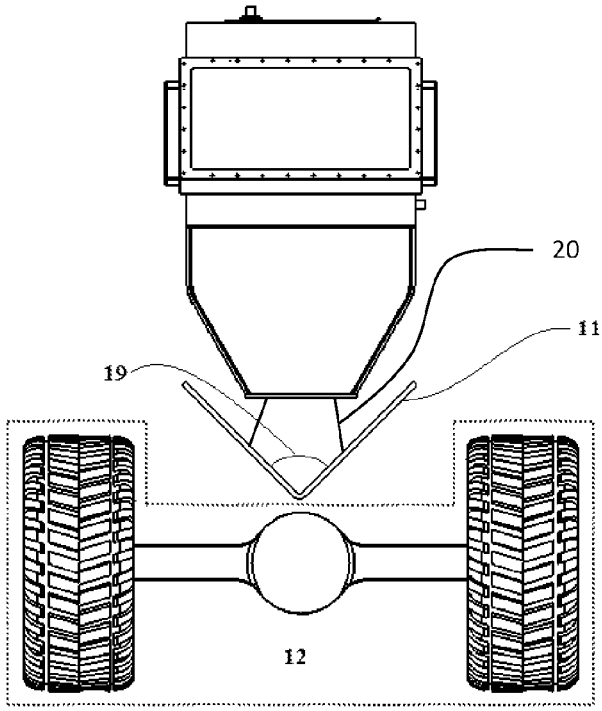
FIG. 5 shows a front view of the location of the survivability capsule and V-deflector plate relative to a traditional vehicle and chassis.

FIG. 5 shows the narrow V-deflector plate 11 in place below the narrow survivability capsule 1 with a traditional chassis configuration. The V-deflector plate may be comprised of two or more plates, a single bent plate, or multiple plates with multiple bends. In any case, the V-deflector plate will have at least two surfaces sloped upwards at an angle 19 of 40°-120° relative to each other. In this arrangement, the cab is positioned centered above the chassis 12. The V-deflector plate may be mounted using a structure 20 designed to dissipate energy from underbody blasts by deforming ("crumple zone").

Figure 6:
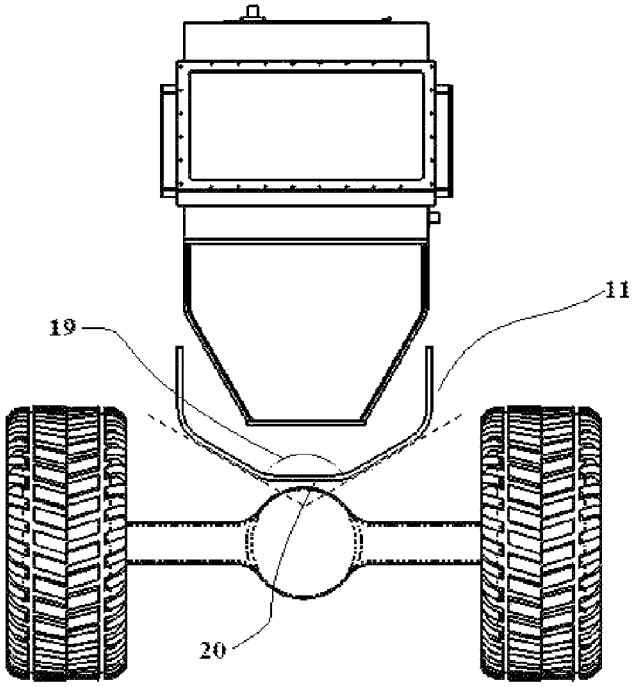
FIG. 6 shows a front view of the location of the survivability capsule and an alternate V-deflector plate design relative to a traditional vehicle and chassis.

FIG. 6 shows an alternative embodiment of the narrow V-deflector plate 11 in place below the narrow survivability capsule 1 with a traditional chassis configuration. In this alternative embodiment, a flat section 20 is included in the V-deflector design to reduce the height while still maintaining the angle 19 between the sides to maintain blast protection. In this arrangement, the cab is positioned centered above the chassis 12.

Figure 7:
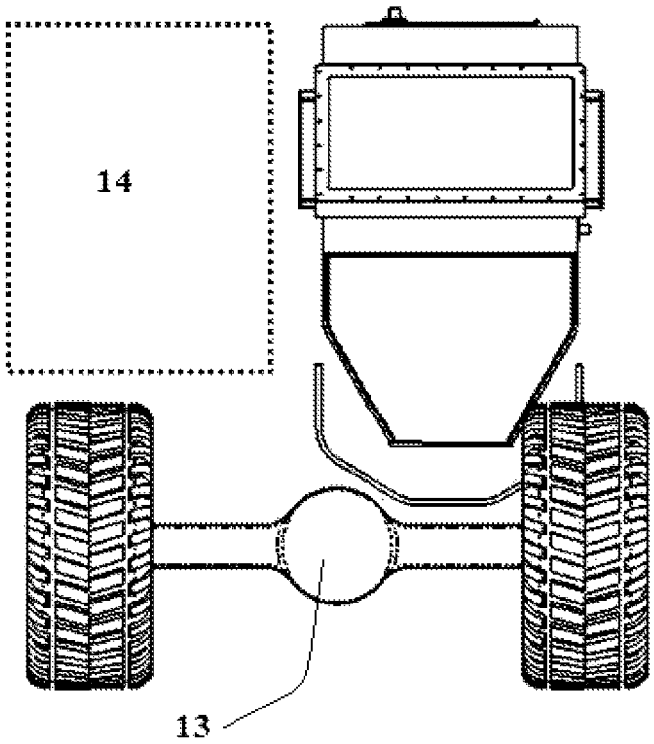
FIG. 7 shows a front view of the location of an offset survivability capsule and V-deflector plate relative to the vehicle chassis.

FIG. 7 shows the location of the V-deflector plate 11 and survivability capsule 1 relative to the vehicle chassis and driveline components 13. This figure clearly shows that the V-deflector plate and survivability capsule are located off-center relative to the vehicle, resulting in positioning alongside rather than on top or around other traditionally-centered components such as the transmission, transfer case, and driveline components. The offset location of the V-deflector plate may be to either side of the vehicle, just as a particular automobile may be produced in either left-hand or right-hand drive. While the centerline of the capsule is offset from the centerline of the vehicle, the amount of offset will be determined by other vehicle characteristics including chassis dimensions, and required survivability capsule dimensions. The area opposite the survivability capsule 14 may be enclosed or left open. When enclosed, this area not only provides a location for cargo and other materials, but provides space for the implementation of a spaced armor array which can be comprised of materials sufficient to defeat roadside threats including EFPs, RPGs, and RKG-3s. When a spaced armor array is employed, it will be attached to the inward facing side of the survivability capsule. Because this enclosed area is on what would notionally be referred to as the vehicle's "passenger-side", this area is located between the vehicle occupants and the most likely side to be attacked by enemy personnel or roadside IEDs. However, it should be noted that the location of the enclosed area is not limited to the vehicle's "passenger-side" and may in fact be located on the driver's side, depending on which side the survivability capsule is located.

Figure 8:
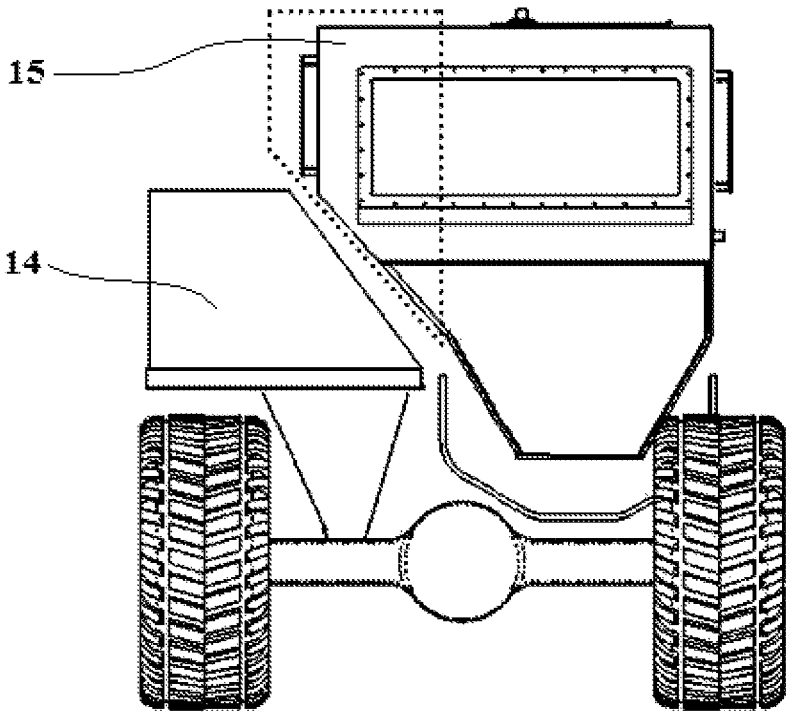
FIG. 8 shows a front view of an example of an offset asymmetric cab construction.

FIG. 8 shows an example where the survivability capsule 1 is constructed asymmetrically, retaining the desirable survivability characteristics of narrow underbody V-deflector plate 11. This asymmetric cab design is wider at the top than at the bottom such that there is additional room 15 inside the survivability capsule for required equipment such as radios, personal weapons, electronic warfare devices, weapons control, or other required displays.

Figure 9:
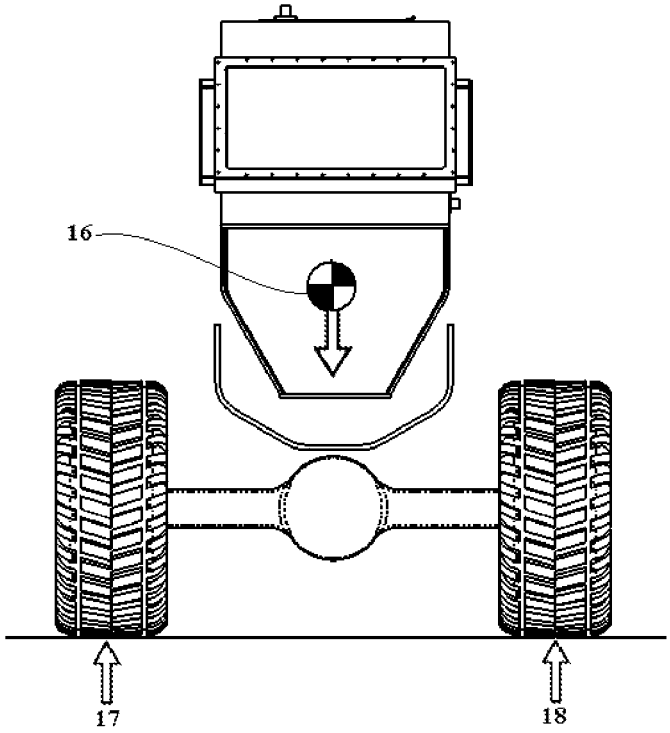
FIG. 9 shows a front view of the notional center of gravity (CG) of a vehicle with a traditional layout and the relative magnitude of the resulting forces on the road bed during transit.

FIG. 9 shows the resulting CG location 16 of the overall vehicle, and the relative magnitude of the road bed loading under the right- 17 and left-hand 18 wheels during low-speed or straight-line operation with the survivability capsule positioned offset from the chassis center line. This illustrates the reduction in road bed loading underneath the vehicle wheels 17 located on the edge of the road, resulting in decreased incidences of road bed collapse and subsequent roll-over.

Figure 10:
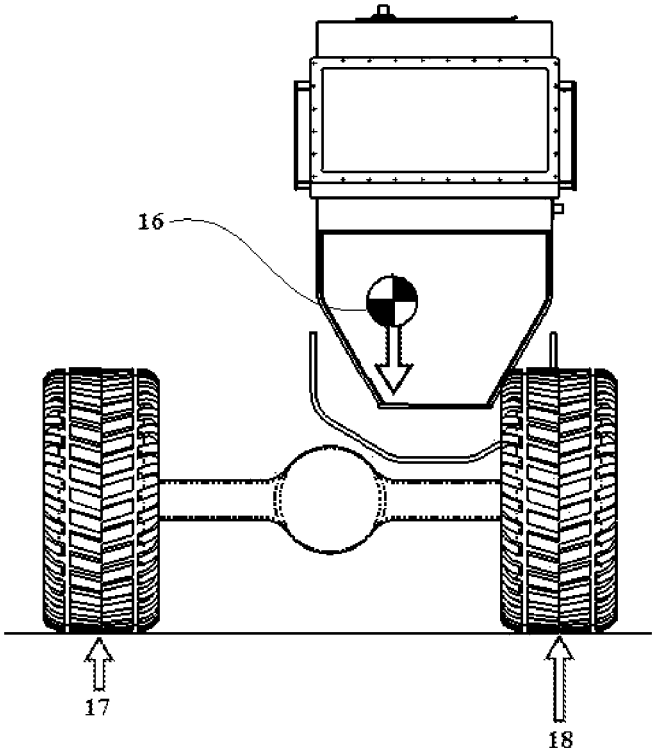
FIG. 10 shows a front view of the notional CG of a vehicle with an offset cab layout and the relative magnitude of the resulting forces on the road bed during transit.

FIG. 10 shows the resulting CG location 16 of the overall vehicle, and the relative magnitude of the road bed loading under the right- 17 and left-hand 18 wheels during low-speed or straight-line operation with the survivability capsule positioned in a traditional, centered layout. The right- 17 and left-hand 18 road bed loading are equal in this configuration. It should be noted that FIGS. 1-10 depict embodiments by example only. Other embodiments will be apparent to those of requisite skill in the art.

This type of vehicle construction may utilize a commercially available chassis, an existing military chassis, or a custom-designed chassis, and may incorporate body-on-frame or unibody construction. The chassis may have two axles or three axles. Materials used in the construction of the survivability capsule may include steel, ceramic, or composite and these materials may be employed structurally, or using a space-frame construction in which lightweight materials are supported by a more rigid frame providing structural stability.

The overall vehicle construction enables a reduced vehicle width required for successful navigation on narrow roads and mountain passes. The narrow survivability capsule and V-deflector plate provide desirable underbody blast survivability, and the offset survivability capsule location provides the opportunity to use a large spaced armor array to defeat EFP, RPG, and RKG-3 threats from the most likely threat location.

In operation, the Reduced Size, Symmetrical and Asymmetrical Crew Compartment Vehicle is operated by a crew of two or three in the same manner as conventional military vehicles. The vehicle's narrow width and asymmetric road bed loading enable it to traverse narrow roadways not passable by larger or heavier vehicles. The offset location of the survivability capsule provides the means to deliver significant threat protection from the higher-threat side, and the narrow width of the capsule and V-deflector plate provides exceptional underbody survivability characteristics.

The invention claimed is:

1. An armored wheeled vehicle, comprising:
a chassis having a centerline;
a set of driveline components substantially aligned with the centerline;
a survivability capsule mounted to the chassis, having a top, bottom, front, back, at least two sides, wherein the survivability capsule is configured to seat two occupants inline, and wherein the survivability capsule is asymmetrically offset from the centerline when viewed from the front such that the survivability capsule is substantially alongside the set of driveline components;
a v-deflector plate mounted along the length of the bottom of the survivability capsule; and
an EFP defeating spaced armor attached to the side of the survivability capsule nearest to the centerline.

2. The armored wheeled vehicle of claim 1, wherein the armored wheeled vehicle has a width of 96 inches or less.

3. The armored wheeled vehicle of claim 1, wherein the armored wheeled vehicle has a weight of 25,000 lbs or less.

4. The armored wheeled vehicle of claim 1, wherein the survivability capsule is asymmetrical such that width of the top of the survivability capsule is greater than the width of the bottom.

5. The armored wheeled vehicle of claim 1, wherein the v-deflector plate is mounted to the survivability capsule with an energy dissipating structure that deforms when it encounters underbody blasts.

6. The armored wheeled vehicle of claim 1, wherein the survivability capsule is further comprised of one or more doors hinged to the side closest to the edge of the armored wheeled vehicle.

7. The armored wheeled vehicle of claim 1, wherein the survivability capsule is further comprised of one or more doors hinged to the back.

8. The armored wheeled vehicle of claim 1, wherein the survivability capsule is further comprised of a push-out windshield attached to the front.

9. The armored wheeled vehicle of claim 1, wherein the survivability capsule is further comprised of an overhead hatch attached to the top.

10. The armored wheeled vehicle of claim 1, wherein a weapon system is attached to the top of the survivability capsule.

11. The armored wheeled vehicle of claim 1, wherein a weapon system is attached to the side of the survivability capsule.

12. The armored wheeled vehicle of claim 1, wherein the v-deflector plate is further comprised of at least two surfaces sloped upwards at an angle between 40° and 120° relative to each other.

13. The armored wheeled vehicle of claim 1, wherein the v-deflector plate is further comprised of a flat section that reduces the depth of the v-deflector while still having at least two surfaces sloped upwards at an angle between 40° and 120° relative to each other.

14. The armored wheeled vehicle of claim 1, further comprising at least two axles operatively connected to the chassis and at least four wheels, each operatively connected to the at least two axles.

15. An armored wheeled vehicle, comprising:
a chassis having a centerline;
a set of driveline components substantially aligned with the centerline;
a survivability capsule mounted to the chassis, having a top, bottom, front, back, at least two sides, wherein the survivability capsule is configured to seat two occupants inline, wherein the survivability capsule is asymmetrically offset from the centerline when viewed from the front such that the survivability capsule is substantially alongside the set of driveline components, and wherein the width of the top of the survivability capsule is substantially greater than the width of the bottom; and
a v-deflector plate mounted along the length of the bottom of the survivability capsule; and
an EFP defeating spaced armor attached to the side of the survivability capsule nearest to the centerline.

16. The armored wheeled vehicle of claim 15, wherein the armored wheeled vehicle has a width of 96 inches or less.

17. The armored wheeled vehicle of claim 15, wherein the armored wheeled vehicle has a weight of 25,000 lbs or less.

18. The armored wheeled vehicle of claim 15, wherein the v-deflector plate is mounted to the survivability capsule with an energy dissipating structure that deforms when it encounters underbody blasts.

19. The armored wheeled vehicle of claim 15, wherein the survivability capsule is further comprised of one or more doors hinged to the side closest to the edge of the armored wheeled vehicle.

* * * * *